US009899716B1

(12) United States Patent
Ligander et al.

(10) Patent No.: US 9,899,716 B1
(45) Date of Patent: Feb. 20, 2018

(54) WAVEGUIDE E-PLANE FILTER

(71) Applicant: Telefonaktiebolaget LM Ericsson (publ), Stockholm (SE)

(72) Inventors: Per Ligander, Göteborg (SE); Lars Bolander, Mölndal (SE); Anatoli Deleniv, Mölndal (SE); Ove Persson, Hunnebostrand (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 0 days.

(21) Appl. No.: 15/547,998

(22) PCT Filed: Mar. 1, 2015

(86) PCT No.: PCT/EP2015/054226

§ 371 (c)(1),
(2) Date: Aug. 1, 2017

(87) PCT Pub. No.: WO2016/138916

PCT Pub. Date: Sep. 9, 2016

(51) Int. Cl.

| | |
|---|---|
| ***H01P 1/207*** | (2006.01) |
| ***H01P 1/213*** | (2006.01) |
| ***H01Q 13/08*** | (2006.01) |
| ***H01Q 1/24*** | (2006.01) |
| ***H01Q 5/50*** | (2015.01) |
| ***H01P 1/211*** | (2006.01) |
| ***H01P 1/212*** | (2006.01) |
| ***H01P 1/20*** | (2006.01) |

(52) U.S. Cl.
CPC ..... *H01P 1/2138* (2013.01); *H01P 1/20* (2013.01); *H01P 1/2002* (2013.01); *H01P 1/207* (2013.01);

(Continued)

(58) Field of Classification Search
CPC ..... H01P 1/207; H01P 1/211; H01P 1/212; H01P 1/20; H01P 1/2002; H01P 1/2138
(Continued)

(56) References Cited

U.S. PATENT DOCUMENTS 3,451,014 A * 6/1969 Curley ..... H01P 1/212 333/110
3,597,710 A * 8/1971 Levy ..... H01P 1/211 333/210

(Continued)

FOREIGN PATENT DOCUMENTS

WO 2012016584 A1 2/2002

OTHER PUBLICATIONS

Vahldieck, R. et al., "Computer-Aided Design of Parallel-Connected Millimeter-Wave Diplexers/Multiplexers",1988 IEEE MTT-S Digest, May 25, 1988, pp. 435-438.

*Primary Examiner* — Dameon E Levi
*Assistant Examiner* — Ab Salam Alkassim, Jr.
(74) *Attorney, Agent, or Firm* — Coats & Bennett, PLLC

(57) ABSTRACT

It is provided a waveguide E-plane band-pass filter comprising a tubular, electrically conductive waveguide body. An electrically conductive foil is arranged in the waveguide body and extending along a longitudinal direction of the waveguide body, the foil comprising a plurality of resonator openings. Furthermore, the waveguide body comprises at least one ridge protruding from an inner wall of the waveguide body and extending longitudinally along the longitudinal direction of the waveguide body. The foil is in mechanical contact with said at least one ridge and arranged to divide an inner volume of the waveguide body into two portions. It is also provided a diplexer, a radio transceiver, and a method for filtering a signal using such a filter.

17 Claims, 7 Drawing Sheets

(52) U.S. Cl.
CPC ..... *H01P 1/211* (2013.01); *H01P 1/212* (2013.01); *H01Q 1/246* (2013.01); *H01Q 5/50* (2015.01); *H01Q 13/085* (2013.01)

(58) Field of Classification Search
USPC ..... 333/208, 209, 210, 211, 212; 343/905
See application file for complete search history.

(56) References Cited

U.S. PATENT DOCUMENTS 3,825,863 A * 7/1974 Meier ..... H01P 3/123 333/239
4,028,650 A * 6/1977 Konishi ..... H01P 1/00 333/210
4,060,778 A * 11/1977 Hefni ..... H01P 1/209 333/211
4,626,809 A * 12/1986 Mizumura ..... H01P 1/2084 333/202
4,661,999 A * 4/1987 Ullmann ..... H03D 9/0616 333/208
4,706,051 A * 11/1987 Dieleman ..... H01P 11/007 29/464
4,749,973 A * 6/1988 Kaneko ..... H05B 6/707 219/696
4,761,625 A * 8/1988 Sharma ..... H01P 1/2016 333/209
4,800,349 A * 1/1989 Gurcan ..... H01P 1/207 333/202
4,897,623 A * 1/1990 Reindel ..... H01P 1/207 333/208
4,990,870 A * 2/1991 Reindel ..... H01P 1/207 333/208
5,004,993 A * 4/1991 Reindel ..... H01P 1/2016 333/208
5,051,713 A * 9/1991 Yokota ..... H01P 1/122 333/212
5,708,404 A * 1/1998 Kurisu ..... H01P 1/2086 333/202
6,169,466 B1 * 1/2001 Goulouev ..... H01P 1/211 333/210
6,392,508 B1 * 5/2002 Damphousse ..... H01P 1/207 333/209
6,657,520 B2 * 12/2003 Mack ..... H01P 1/207 333/208
6,724,280 B2 * 4/2004 Shamsaifar ..... H01P 1/207 333/209
6,876,277 B2 * 4/2005 Cooper ..... H01P 1/207 333/208
7,023,302 B2 * 4/2006 Peterson ..... H01P 1/207 333/208
7,057,482 B2 * 6/2006 Helme ..... H01P 1/207 333/209
7,132,909 B2 * 11/2006 Mack ..... H01P 1/207 333/157
7,142,074 B2 * 11/2006 Kim ..... H01P 1/207 333/208
7,288,944 B1 * 10/2007 Tonn ..... G01R 27/2664 324/637
7,292,123 B2 * 11/2007 Tong ..... H01P 1/2016 333/208
7,456,711 B1 * 11/2008 Goldsmith ..... H01P 1/207 333/209
7,898,368 B2 * 3/2011 Shen ..... H01P 1/211 333/208
8,633,861 B2 * 1/2014 De Luca ..... G01R 29/10 343/756
8,878,635 B2 * 11/2014 Miyamoto ..... H01P 1/207 333/209
8,975,985 B2 * 3/2015 Meuriche ..... H01P 1/207 333/209
8,988,171 B2 * 3/2015 Kai ..... H01P 1/207 333/208
9,077,062 B2 * 7/2015 Brady ..... H01P 1/2084
9,263,785 B2 * 2/2016 Ligander ..... H01P 1/2016
9,472,836 B2 * 10/2016 Deleniv ..... H01P 1/2016
9,647,307 B2 * 5/2017 Zhou ..... H01P 1/208
9,799,937 B2 * 10/2017 Deleniv ..... H01P 1/201
2002/0044032 A1 * 4/2002 Guguen ..... H01P 1/208 333/212
2002/0097116 A1 * 7/2002 Mack ..... H01P 1/207 333/208
2003/0020570 A1 * 1/2003 Mack ..... H01P 1/207 333/248
2004/0017272 A1 * 1/2004 Smith ..... H01P 1/207 333/209
2005/0030132 A1 * 2/2005 Shamsaifar ..... H01P 1/207 333/209
2005/0073379 A1 * 4/2005 Helme ..... H01P 1/207 333/209
2005/0151603 A1 * 7/2005 Peterson ..... H01P 1/207 333/208
2005/0184835 A1 * 8/2005 Mack ..... H01P 1/207 333/248
2005/0270125 A1 * 12/2005 Higgins ..... H01P 1/2088 333/209
2007/0262835 A1 * 11/2007 Vanin ..... H01P 1/208 333/212
2011/0084783 A1 * 4/2011 Jinnai ..... H01P 1/207 333/209
2011/0241795 A1 * 10/2011 Kai ..... H01P 1/207 333/135
2012/0126914 A1 * 5/2012 Miyamoto ..... H01P 1/207 333/209
2012/0293283 A1 * 11/2012 Vangala ..... H01P 1/2088 333/209
2013/0038407 A1 * 2/2013 Deleniv ..... H01P 1/2016 333/135
2013/0135064 A1 * 5/2013 Ligander ..... H01P 1/2016 333/209
2013/0154772 A1 * 6/2013 Politi ..... H01P 1/207 333/212
2013/0169384 A1 * 7/2013 Meuriche ..... H01P 1/207 333/209
2013/0229244 A1 * 9/2013 Brady ..... H01P 1/2084 333/212
2014/0176379 A1 * 6/2014 Kuo ..... H01P 1/211 343/781 R
2015/0137911 A1 * 5/2015 Kai ..... H01P 1/2088 333/208
2015/0188208 A1 * 7/2015 Sun ..... H01P 1/207 505/210
2015/0236392 A1 * 8/2015 Iwanaka ..... H01P 1/207 333/208
2015/0280299 A1 * 10/2015 Lee ..... H01P 1/208 333/208
2015/0372368 A1 * 12/2015 Pinta ..... H05K 1/02 343/905
2015/0380793 A1 * 12/2015 Park ..... H01P 1/2136 333/135
2016/0006094 A1 * 1/2016 Shiroyama ..... H01P 1/207 343/850
2016/0056541 A1 * 2/2016 Tageman ..... H01Q 13/18 343/771
2016/0118702 A1 * 4/2016 Xu ..... H01P 1/207 333/209
2016/0294034 A1 * 10/2016 Yoshikawa ..... H01P 1/2084
2016/0308264 A1 * 10/2016 Vangala ..... H01P 1/2002
2016/0315368 A1 * 10/2016 Liang ..... H01P 7/04
2017/0084971 A1 * 3/2017 Kildal ..... H01P 1/2005
2017/0244146 A1 * 8/2017 Ligander ..... H01P 3/12

* cited by examiner

WAVEGUIDE E-PLANE FILTER

TECHNICAL FIELD

The present disclosure relates to a waveguide E-plane band-pass filter and to a transceiver comprising such a filter. The present disclosure also relates to a method of filtering a signal using a waveguide E-plane band-pass filter.

BACKGROUND

Abase station for a mobile communication system and microwave radio links used for data transport typically comprise one or more transceiver units connected to an antenna for transmitting and receiving microwave signals. These transceivers in turn comprise a diplexer/duplexer consisting of at least two band-pass filters. The filters of the diplexer may have different passbands so as to, e.g., prevent intermodulation between a transmission signal and a received signal. Herein, when referring to a passband of a filter, it is appreciated that a passband is defined by a center frequency and a bandwidth, the bandwidth being measured, e.g., when the return loss is lower than a certain level, such as −20 dB.

Microwave filters can be of the transmission line type, such as a microstrip arranged on a dielectric carrier. However, hollow metal waveguides are more often used as filters due to lower losses and a higher power capability compared to microstrip filters, even though a hollow waveguide filter will have a larger size than a microstrip filter.

The dimensions of a hollow waveguide filter are dependent on the frequency of the signal to be filtered, the selected filtering properties such as a certain passband, and on the type of filter used. Since the size of the waveguide must be on the same order as the wavelength of the frequency of the signal that is to be filtered, hollow waveguides are typically used for frequencies in the GHz range which have wavelengths in the mm range.

In some applications, such as in outdoor microwave radio or radio base station units, there are strict size limitations which must be adhered to. Thereby, the available space also dictates which type of filter can be used. It is therefore often desirable to reduce the size of a filter without degradation of the frequency properties of the filter. As an example, waveguide H-plane type filters are known to have advantageous frequency properties and they also can be made smaller than other comparable types of filters such as E-plane filters. However, H-plane filters require a large number of tuning positions making it costly and complicated to tune the filters.

A known alternative to H-plane filters are waveguide E-plane filters which do not need to be tuned. In an E-plane filter, a conductive foil or insert is arranged in the waveguide filter at or close to the location where the strength of the E-field (V/m) is the highest. The foil or insert comprises openings which act as resonators, thereby determining the poles of the filter, and consequently also contribute to determining the passband of the filter. However, an E-plane filter can not be made as small as an H-plane filter with the same filtering properties.

Accordingly, it is desirable to provide an improved waveguide filter which is both comparatively small in order to be used within a restricted space and also uncomplicated to manufacture, without degradation of the filtering properties.

SUMMARY

In view of above-mentioned and other desired properties of a microwave filter, it is an object of the present technique to provide an improved waveguide E-plane band-pass filter having a reduced size compared to prior art E-plane filters.

According to a first aspect, it is provided a waveguide E-plane band-pass filter comprising a tubular, electrically conductive waveguide body. An electrically conductive foil is arranged in the waveguide body and extending along a longitudinal direction of the waveguide body, the foil comprising a plurality of resonator openings. Furthermore, the waveguide body comprises at least one ridge protruding from an inner wall of the waveguide body and extending longitudinally along the longitudinal direction of the waveguide body. The foil is in mechanical contact with said at least one ridge and arranged to divide an inner volume of the waveguide body into two portions.

The technique disclosed herein is based on a realization that a waveguide E-plane band-pass filter can be provided which is reduced in size in comparison with known E-plane band-pass filters while maintaining, or in some cases even improving, the filter properties, by arranging at least one ridge within the waveguide body, and by arranging the electrically conductive foil in mechanical contact with the ridge.

According to some aspects, the foil is arranged to divide the inner volume of the waveguide body into two portions of equal dimension.

According to some further aspects, a cross section of a ridge has the same shape along the full length of the ridge. As an example, the ridge can have a rectangular cross section.

According to some aspects, the ridge comprises a plurality of protruding elements, where a distance between adjacent protruding elements does not exceed a quarter of a wavelength of a center frequency of the filter.

According to some aspects, the foil is in mechanical contact with a central portion of the ridge along a longitudinal length of the ridge.

According to some aspects, the size and shape of the ridge is selected such that a first harmonic frequency, and also higher mode frequencies, of the filter are higher than 1.5 times a center frequency of said filter.

According to some aspects, the foil is arranged along a symmetry line of the filter running along a longitudinal direction of the filter dividing the waveguide body into two symmetrical parts.

According to some aspects, the waveguide body comprises two body elements, where each body element comprises one half of a ridge and the foil being arranged at an interface between the two body elements.

According to some aspects, the waveguide body comprises at least two body elements, where one of the body elements comprises a ridge.

According to further aspects, the waveguide body has a rectangular cross section.

According to some aspects, the filter comprises two ridges protruding from opposing walls of the waveguide body. In a filter comprising two ridges, the foil is arranged extending between the two ridges according to some aspects.

According to some aspects, in a filter comprising two ridges, a cross section of the two ridges have the same shape along the longitudinal length of the two ridges. In some aspects, the two ridges are arranged opposing each other.

The object stated above is also obtained by a diplexer unit comprising a first filter according to any one of the above discussed filters. The filter is configured to be operatively connected to a radio transmitter and having a first passband and a second filter according to any one of the above discussed filters, the filter being configured to be operatively connected to a receiver and having a second passband.

The object stated above is further obtained by a radio transceiver comprising a radio transmitter, a radio receiver, a diplexer unit as discussed above. The diplexer is operatively connected to the radio transmitter and to the radio receiver and to an antenna.

The object stated above is also obtained by a method for filtering a microwave signal in a waveguide E-plane band-pass filter. The method comprises providing a microwave signal to the filter, band-pass filtering the signal using the waveguide E-plane band-pass filter forming a filtered signal. The waveguide E-plane band-pass filter comprises at least one internal ridge protruding from an inner wall of the waveguide body and extending longitudinally along the longitudinal direction of the waveguide body.

The object stated above is also obtained by a method for filtering a microwave signal in a radio transceiver comprising a waveguide E-plane band-pass filter. The method comprises acquiring a signal from an antenna, band-pass filtering the signal using the waveguide E-plane band-pass filter forming a filtered signal and providing the filtered signal to a receiver module of the radio transceiver. The waveguide E-plane band-pass filter comprises at least one internal ridge protruding from an inner wall of the waveguide body and extending longitudinally along the longitudinal direction of the waveguide body.

The object stated above is also obtained by a method for filtering a microwave signal in a radio transceiver comprising a waveguide E-plane band-pass filter. The method comprises generating a signal by a radio transmitter module of said transceiver, band-pass filtering the signal using the waveguide E-plane band-pass filter forming a filtered signal and providing the filtered signal to an antenna. The waveguide E-plane band-pass filter comprises at least one internal ridge protruding from an inner wall of the waveguide body and extending longitudinally along the longitudinal direction of the waveguide body According to some aspects, in the methods discussed above, a cross-section of the at least one ridge of the waveguide E-plane band-pass filter has the same shape along the full length of the at least one ridge.

According to some aspects, in the methods discussed above, a waveguide E-plane band-pass filter comprises two ridges protruding from opposing inner walls of the waveguide.

The object stated above is also obtained by a radio transceiver module for filtering a microwave signal. The transceiver comprises an antenna module for transmitting and receiving a microwave signal a first waveguide E-plane band-pass filter module for band-pass filtering a transmission signal to form a filtered transmission signal. The filter module comprises at least one internal ridge protruding from an inner wall of a waveguide body and extending longitudinally along the longitudinal direction of the waveguide body. The transceiver further comprises a second waveguide E-plane band-pass filter module for band-pass filtering an acquired signal to form a filtered acquired signal. The second filter module comprises at least one internal ridge protruding from an inner wall of a waveguide body and extending longitudinally along the longitudinal direction of said waveguide body. The transceiver further comprises a radio transmitter module for providing the filtered transmission signal to an antenna, and a receiver module for receiving the filtered acquired signal from said filter.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. Further features of, and advantages with, the present technique will become apparent when studying the appended claims and the following description. The skilled person realize that different features of the present technique may be combined to create embodiments other than those described in the following, without departing from the scope of the present technique.

BRIEF DESCRIPTION OF THE DRAWINGS

The present technique is now described, by way of example, with reference to the accompanying drawings, in which.

DETAILED DESCRIPTION

The present technique will now be described more fully hereinafter with reference to the accompanying drawings, in which certain embodiments of the present technique are shown. The present technique may, however, be embodied in many different forms and should not be construed as limited to the embodiments set forth herein; rather, these embodiments are provided by way of example so that this disclosure will be thorough and complete, and will fully convey the scope of the technique to those skilled in the art. Like numbers refer to like elements throughout the description.

In the following detailed description, various embodiments of the waveguide E-plane filter according to the present technique are mainly described with reference to a filter having a rectangular cross section and to a ridge having a rectangular cross-section.

Figure 1A:
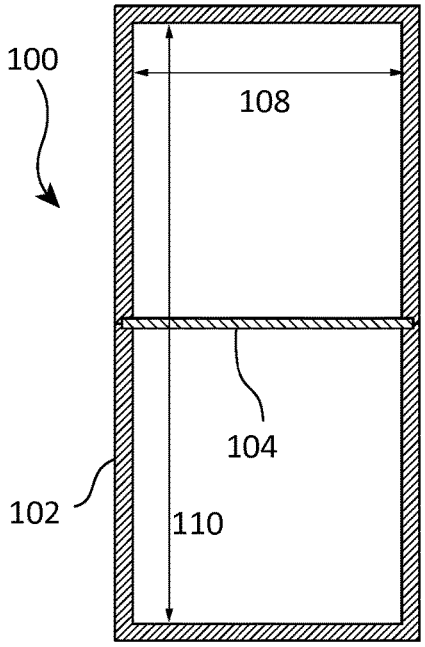
FIGS. 1A-B are schematic illustrations of a prior art filter.
Figure 1B:
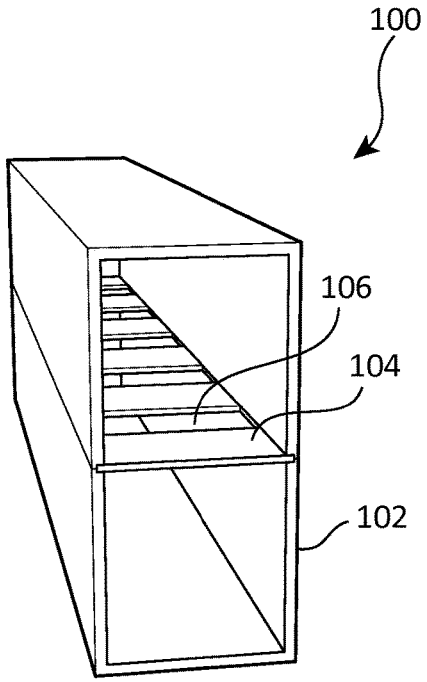

FIG. 1 schematically illustrates a prior art waveguide E-plane band-pass filter 100. The filter 100 of FIG. 1 is used as a comparative example and to outline the general properties of a waveguide E-plane filter 100. The filter 100 comprises a hollow waveguide body 102 and an electrically conductive foil 104. The inner dimensions of the waveguide body 102, i.e. the width 108 and height 110, generally determine the cutoff frequency of a waveguide. In an E-plane filter, an electrically conductive foil 104 is arranged within the waveguide body 102, typically at or close to the center of the waveguide body 102 where the E-field has its maximum value. The foil 104 may also be referred to as a conductive insert or a filter insert. The foil 104 comprises one or more resonator openings 106 which determine the passband of the filter, where each opening corresponds to a pole of the filter. Therefore, the foil 104 is sometimes also referred to as a frequency determining foil 104. The passband is defined as the band around a center frequency where the return loss is lower than a certain level, such as −20 dB. However, the passband may also be defined at other levels of return loss, such as −16 dB, depending on the requirements of the particular application in which the filter is to be used.

As an illustrating example, filter dimensions 108, 110 are given for a filter 100 having a passband with a center frequency at 8 GHz and a bandwidth of approximately 200 MHz. Such a filter 100 has a width 108 of 12.6 mm and a height of 28.5 mm.

Figure 2A:
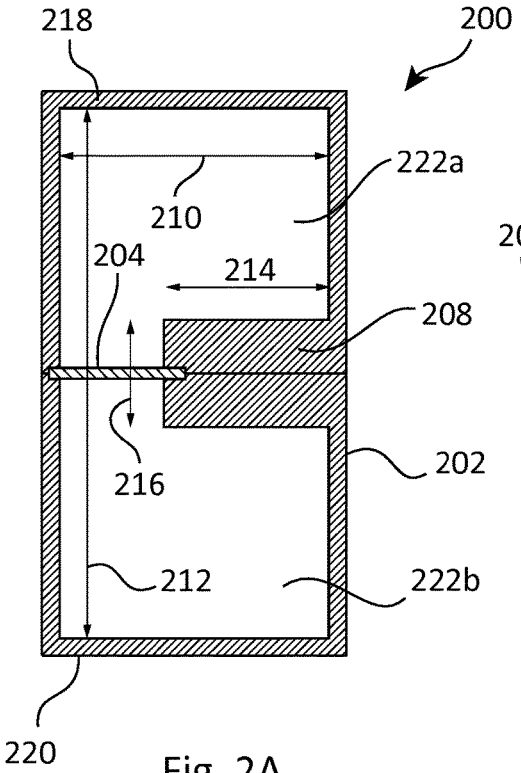
FIGS. 2A-B are schematic illustrations of a filter according to an embodiment of the present technique.
Figure 2B:
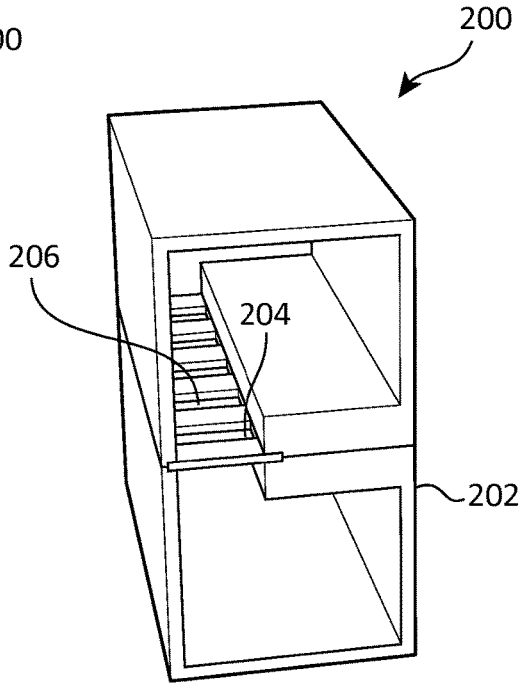

FIGS. 2A-B schematically illustrate a filter 200 according to an example embodiment of the present technique. The filter 200 comprises a tubular, electrically conductive, waveguide body 202 having a rectangular cross-section. A tubular waveguide body 202 should herein be understood as a waveguide body being hollow and elongated. The waveguide body 202 is here being illustrated as an open-ended waveguide. However, the present technique is equally applicable for a closed waveguide. The filter 200 further comprises an electrically conductive foil 204 arranged in the waveguide body 202 and extending along a longitudinal direction of the waveguide body 202. The electrically conductive foil 204 can for example be made from a metallic material such as copper. As an alternative to copper, other materials having equivalent electrical properties can also be used. The foil comprises a plurality of resonator openings 206, where each resonator opening 206 correspond to a pole of the filter. Thus, the filter 200 illustrated in FIGS. 2A-B is a five-pole filter as a result of the five resonator openings 206. However, the present technique is equally applicable to E-plane filters having any practical number of poles, where the number and dimension of the resonator openings is selected based on the requirements of the particular application for which the filter is to be used.

The filter of FIGS. 2A-B further comprises a ridge 208 protruding from an inner wall of the waveguide body 202 and extending longitudinally along the longitudinal direction of the waveguide body 202. The foil 204 is arranged in mechanical contact with the ridge 208, at the center of the ridge 208 and along the longitudinal length of the ridge 208, and arranged extending in a substantially perpendicular direction from the ridge 208 reaching an opposing wall of the waveguide body 202 to divide an inner volume of the waveguide body 202 into two portions 222*a-b*. Since the foil 204, the ridge 208 and the waveguide body 208 are electrically conductive, the foil 204 is in electrical contact with the waveguide body 202. Even though the foil is illustrated as dividing the inner volume of the waveguide body 202 into two substantially equal portions 222*a-b*, the foil 104 may also be arranged at a position offset from the center of the ridge 207 while still being in mechanical and electrical contact with the ridge 208, the filter still maintaining its filtering properties. Furthermore, the ridge 208 has a rectangular cross-section which has the same shape along the length of the ridge 208, and the ridge extends along the full length of the waveguide body 202. Even though the ridge 208 herein is illustrated as having a rectangular cross-section, the ridge can in principle have an arbitrarily shaped cross-section, such as a triangular cross section or a free form cross-section. Since it is the surface area of the ridge which determines the influence of the ridge on the filter properties, the cross-section shape of the ridge can be selected based on the desired mechanical configuration of the filter and based on manufacturing considerations. In practice, a rectangular cross-section can for example be selected due to the ease of manufacturing. Furthermore, it is not strictly required that a ridge extends along the full length of the waveguide body. However, it should be noted that other configurations where the ridge is shorter than the waveguide body may lead to specific matching requirements for connecting to the filter.

The waveguide body 202 of FIGS. 2A-B is also illustrated as being divided into two substantially similar body elements 218, 220 of equal dimension along an imaginary symmetry line of the waveguide body 202. The foil 204 is arranged between the two body elements 218, 220. However, this is merely one of many different possible configurations of the waveguide body 202 and hence of the filter 200. The waveguide body 202 may for example comprise three or more separate body elements being assembled to form a waveguide body and a ridge. In practice, the specific configuration of waveguide body elements and ridges may be determined based on manufacturing considerations.

Through the use of a ridge 208 in a waveguide E-plane band-pass filter, the dimensions of the filter can be significantly reduced while maintaining similar frequency filtering properties. Taking an 8 Ghz five-pole filter as an illustrative example, as outlined in relation to FIG. 1, a filter configured according to FIGS. 2A-B, having the same passband as the prior art filter of FIG. 1, would have a width 210 of 9.5 mm and a height 212 of 19 mm. Thus, the filter 202 comprising a ridge 208 has a height which is reduced by more than 30% and a width which is reduced by about 25%, giving an overall reduction in cross section area of approximately 50%. Moreover, the length of the conventional filter 100 is about 155 mm, whereas the length of the filter 200 comprising a ridge is about 125 mm, a reduction of 8%. Taken together, this leads to a volume reduction of about 60% which provides a significant advantage for applications where the filter is to be used where the volume is restricted. Moreover, a filter 200 having a reduced size also leads to a reduction in the amount of material needed to manufacture the filter, and thereby to an overall reduction in manufacturing cost.

In FIG. 2A, the ridge 208 has a height 214, defined as the perpendicular protrusion from the inner wall of the waveguide body 202, of 5.8 mm and a width 216 of 4.0 mm. The length of the ridge 208 is the same as the length of the waveguide body 202. As a general principle, the size of the ridge is proportional to the size reduction of filter. However, the size reduction of the filter is in practice limited by the required size of the resonator openings in the foil. It is also possible to manipulate first harmonic and higher order mode suppression of the filter by tuning the geometry of the ridge, and in particular by tuning the surface area of the ridge. Accordingly, the precise dimensions of the ridge are based on design considerations with respect to particular filter requirements. Moreover, as discussed above, the cross-section shape of the ridge can in principle be arbitrarily selected, for example to suit a particular foil having specific dimensions for achieving a desired passband.

It should be noted that the above discussed dimensions are derived from computer simulations, and that a physical filter may have slightly different dimensions and properties, for example due to manufacturing tolerances and trade-offs between size and desired filter characteristics. As an example, manufacturing tolerances for the foil are in the range of +/−5 μm and manufacturing tolerances for the waveguide body and ridge is in the range of +/−30 μm.

Figure 3A:
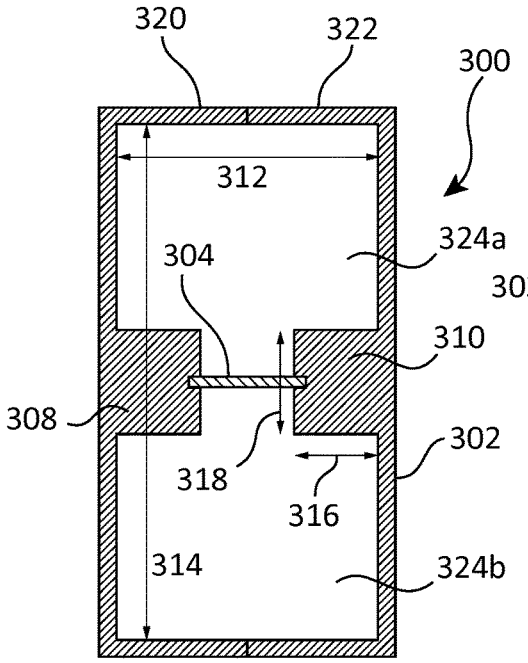
FIGS. 3A-B are schematic illustrations of a filter according to an embodiment of the present technique.
Figure 3B:
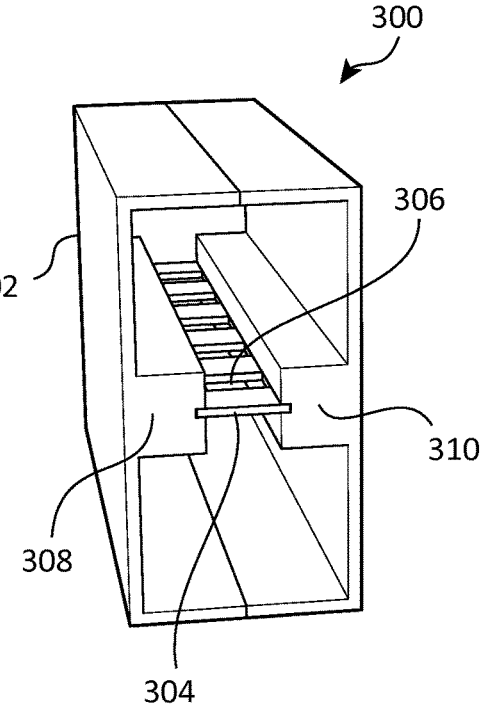

FIGS. 3A-B are schematic illustrations of an embodiment of a waveguide E-plane band-pass filter 300 comprising two opposing ridges 308, 310 extending from opposing sidewalls of the waveguide body 302. The principles of the filter 200 discussed above in relation to FIGS. 2A-B applies also to the filter 300 of FIGS. 3A-B. One consequence of using a filter 300 with two ridges 308, 310 instead of a single ridge 208 is that the two ridges 308, 310 can be made smaller than the single ridge 208. In the present example, the ridges 308, 310 have a height of 3 mm and a width of 4 mm. The remaining dimensions of the waveguide body 302, i.e. the width 312, height 314 and length are the same as for the filter 200 of FIGS. 2A-B.

Furthermore, the filter 300 comprises two waveguide body elements 320, 322, where each element 320, 322 comprises a respective ridge 308, 310. In other words, the waveguide body 302 can be said to be split along the height direction of the body. The skilled person readily realizes that the waveguide body 302 can also be divided in the same manner as the waveguide body 202 in FIGS. 2*a-b*, and that the division shown in FIGS. 3A-B is equally applicable also to the filter 200 of FIGS. 2A-B. Moreover, the two ridges 308, 310 are illustrated as being arranged directly opposite each other. Even though it is desirable to arrange the foil 304 in the region where the E-field is highest, the filter would still function even if one or both of the ridges and/or the foil would be somewhat offset from the center position.

Figure 4:
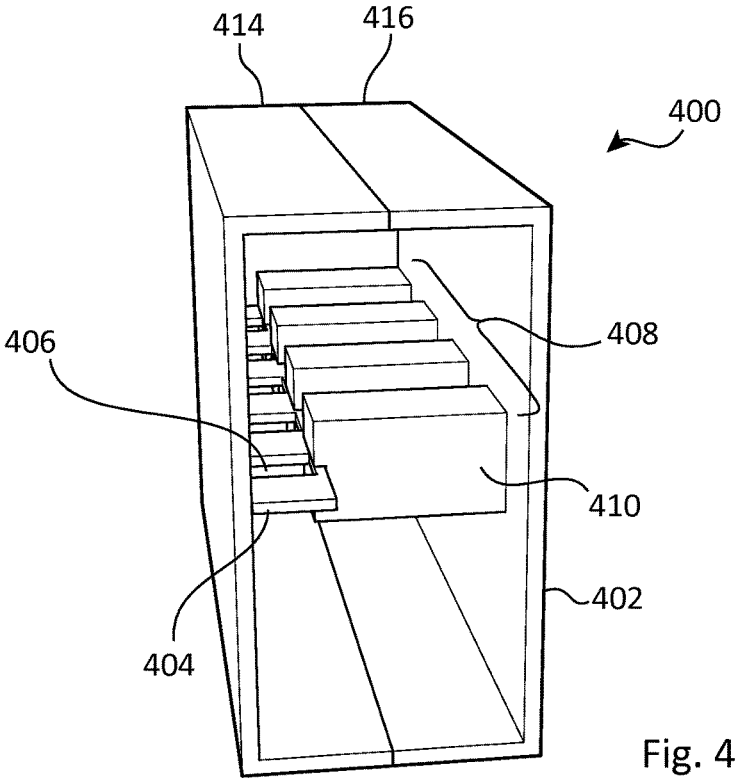
FIG. 4 is a schematic illustration of a filter according to an embodiment of the present technique.

FIG. 4 is a schematic illustration of a filter 400 according to an embodiment of the present technique where the waveguide body 402 comprises a ridge 408 made up of individual elements 410 protruding from an inner wall of the waveguide body 402. As long as the gap between adjacent protruding elements 410 is smaller than approximately a quarter of a wavelength of a center frequency of the filter, the gaps will not interfere with the filter properties. The same requirement also applies to the distance between the outermost protruding elements and the respective edge of the waveguide body 402. However, gaps which are larger than a quarter of a wavelength may case unwanted resonances in the filter. An advantage of using a ridge comprising individual elements is that the material consumption and thereby the weight and cost of the filter can be reduced. Assuming a center frequency of 8 GHz, the wavelength would be 44 mm, and a quarter wavelength would thus be approximately 11 mm.

The cross-section of the filter 400 in FIG. 4 will be the same as the cross-section of the filter 200 in FIG. 2*a* and both of the ridges 208, 408 will have the same cross-section shape and size.

In the same manner as discussed above in relation to the filter 200 of FIGS. 2A-B, the filter 400 comprises a foil 404 having resonator openings 406. Furthermore, the foil 404, ridge 408 and the waveguide body 402 will have the same dimensions as the corresponding dimensions of the filter illustrated in FIG. 2A-B and discussed above given the example of an 8 GHz filter.

Figure 5A:
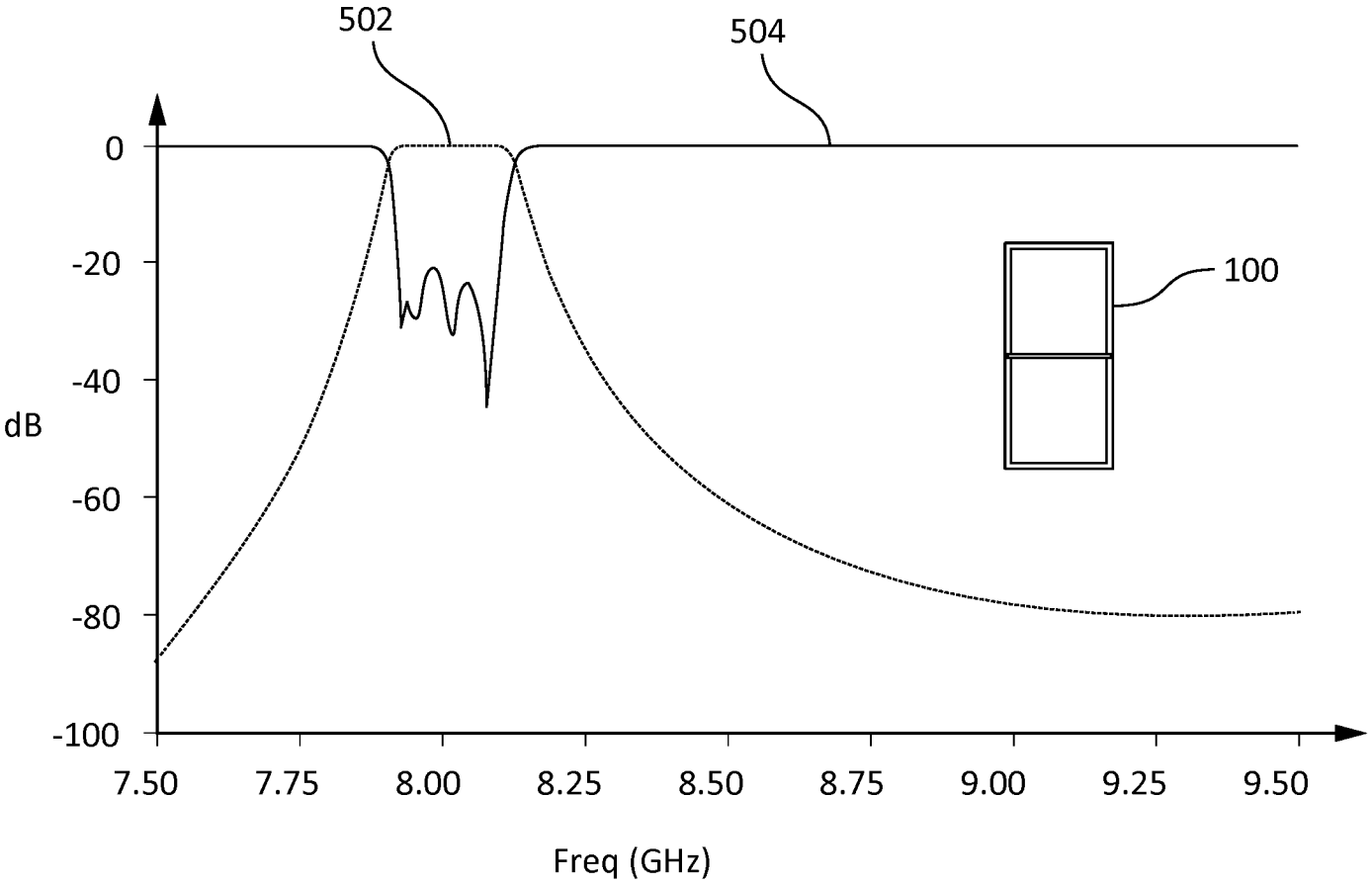
FIG. 5A is a diagram illustrating properties of a prior art filter.
Figure 5B:
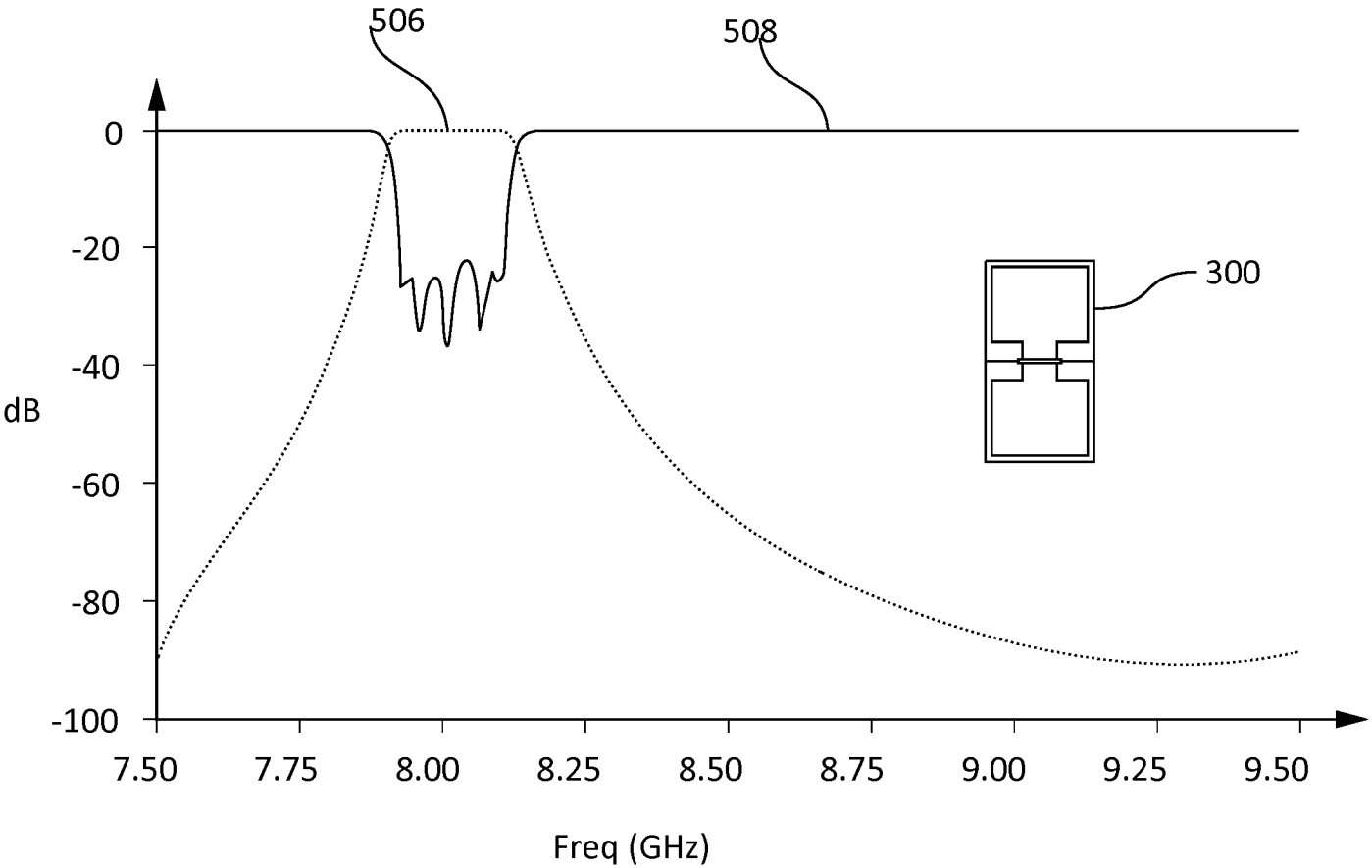
FIG. 5B is a diagram illustrating properties of a filter according to an embodiment of the present technique.

FIGS. 5A-B are diagrams representing computer simulations of the performance of the prior art filter 100 and the filter 300 discussed above. In particular, curve 502 of FIG. 5*a* illustrates the S21 parameter and curve 504 illustrates the S11 parameter of the filter 100, where S21 represents the transmitted signal and S11 the reflected signal in a 2-port network. Likewise, in FIG. 5B the curves 506 and 508 illustrate the S21 and S11 parameters, respectively, of the filter 300 comprising two opposing ridges.

As can be seen when comparing FIG. 5A with FIG. 5B, the passbands of the two filters 100, 300 are substantially the same, illustrating that the above discussed size reduction can be achieved without any noticeable change in passband properties.

Figure 6A:
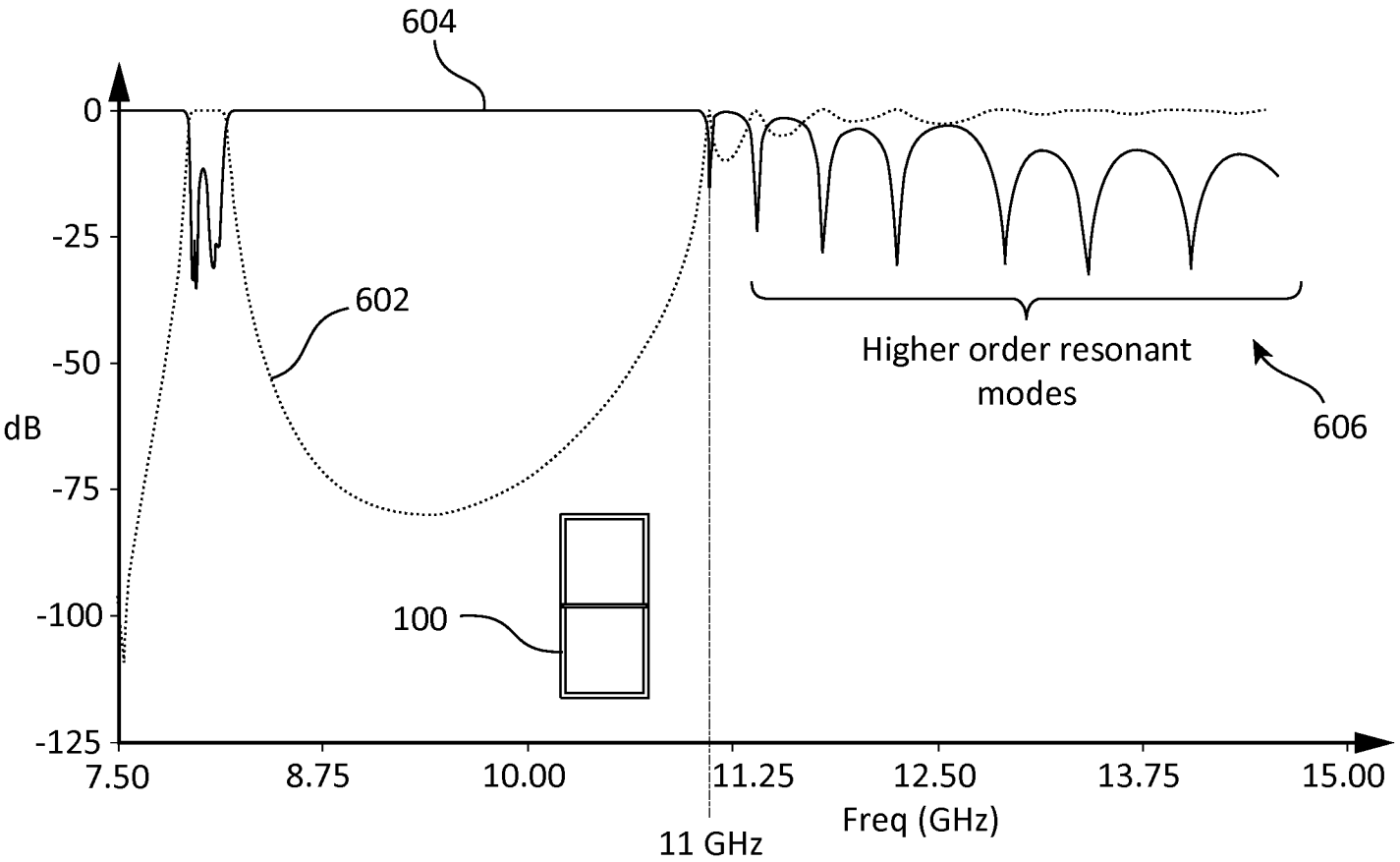
FIG. 6A is a diagram illustrating properties of a prior art filter.
Figure 6B:
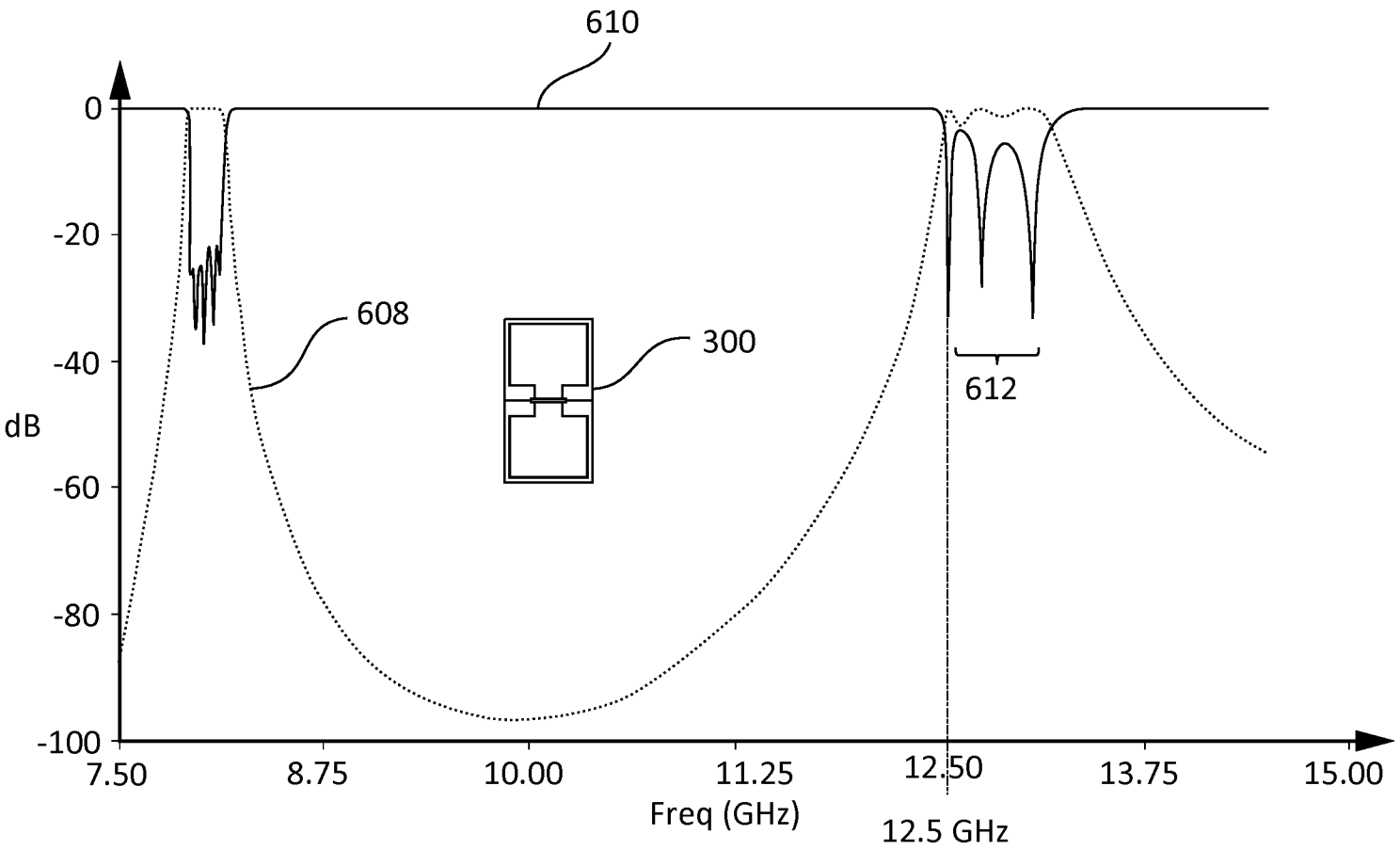
FIG. 6B is a diagram illustrating properties of a filter according to an embodiment of the present technique.

FIGS. 6A-B are diagrams representing computer simulations of the performance of the prior art filter 100 and the filter 300 comprising ridges as discussed above. Similarly to the curves in FIGS. 5A-B, curves 602 and 604 represent the S21 and S11 parameters, respectively, of filter 100. Curves 608 and 610 represent the S21 and S11 parameters, respectively, of the filter 300 comprising ridges. In FIGS. 6A-B, resonant modes for the two filters are shown and by comparing the two diagrams it can be seen in FIG. 6A that the first harmonic is located at approximately 11 GHz and that a number of higher order modes 606 are visible. Comparing this to the filter 300 comprising opposing ridges, the first harmonic 612 in FIG. 6B is located at a higher frequency, namely at 12.5 GHz, compared to the first harmonic of the prior art filter 100. This is an advantage since first harmonic and higher order resonant modes too close to the passband can lead to a higher noise level in the passband. Accordingly, the passband noise level is reduced through the use of a filter comprising a ridge, as a result of the first harmonic being located at a higher frequency compared to in a comparable filter without a ridge.

Furthermore, curve 608 of FIG. 6B show that higher order modes above the first harmonic 612 are suppressed by the filter 300, meaning that the filter in practice also acts as a low-pass filter blocking frequencies above the first order resonant mode 612 This will provide a practical advantage when using the filter 300 in a system since a separate low-pass filter is often required in order to remove the higher order resonant modes 606 illustrated in FIG. 6A. By using the filter 300 comprising a ridge, not only is the filter in itself smaller, it also reduces the overall number of components needed in a system, leading to a notable reduction in size and complexity, and thereby cost. It should also be noted that the same effects have been observed and the same reasoning applies for a filter comprising a single ridge, e.g. the filter 200 illustrated in FIGS. 2A-B.

Figure 7:
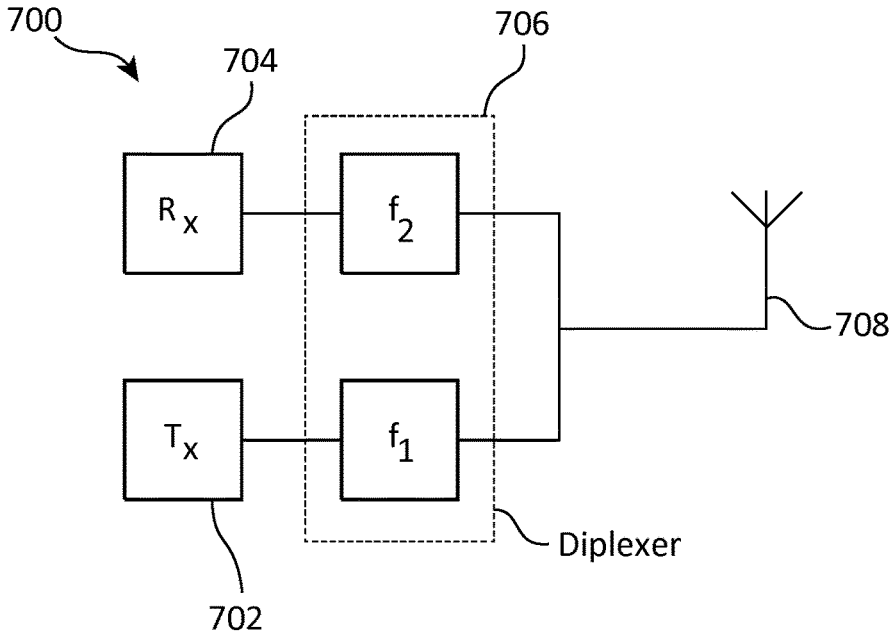
FIG. 7 is a schematic illustration of a transceiver according to an embodiment of the present technique.

FIG. 7 is a schematic illustration of a radio transceiver 700 comprising a radio transmitter 702, a radio receiver 704, a diplexer unit 706 operatively connected to the radio transmitter 702 and to the radio receiver 704, and an antenna 708 operatively connected to the diplexer. The diplexer unit 706 comprises a first filter f1 and a second filter f2, where the filters f1 and f2 are waveguide E-plane band-pass filters comprising a ridge as discussed above. The first filter f1 has a first a first passband and is operatively connected to a radio transmitter 702 ($T_x$), and the second filter f2 has a second passband and is operatively connected to a receiver 704 ($R_x$).

In a diplexer, the passbands of the first and second filter f1, f2, are, in FDD (Frequency Duplex Distance), different and separated form each other in order to separate two different frequency bands in a receive and transmit path and to combine them in a antenna path. This is of importance for example in telecommunication systems where different frequency bands are handled by the same transceiver.

The passbands of the first and second filter f1, f2, can also be the same. The same $T_x$ and $R_x$ frequency can for example be used in a TDD (Time Duplex Distance) or with a OMT (Orthomode Transducer) based system, or in a full duplex system where cancellation is used to remove self-interference.

Figures 8A, 8B, 8C:
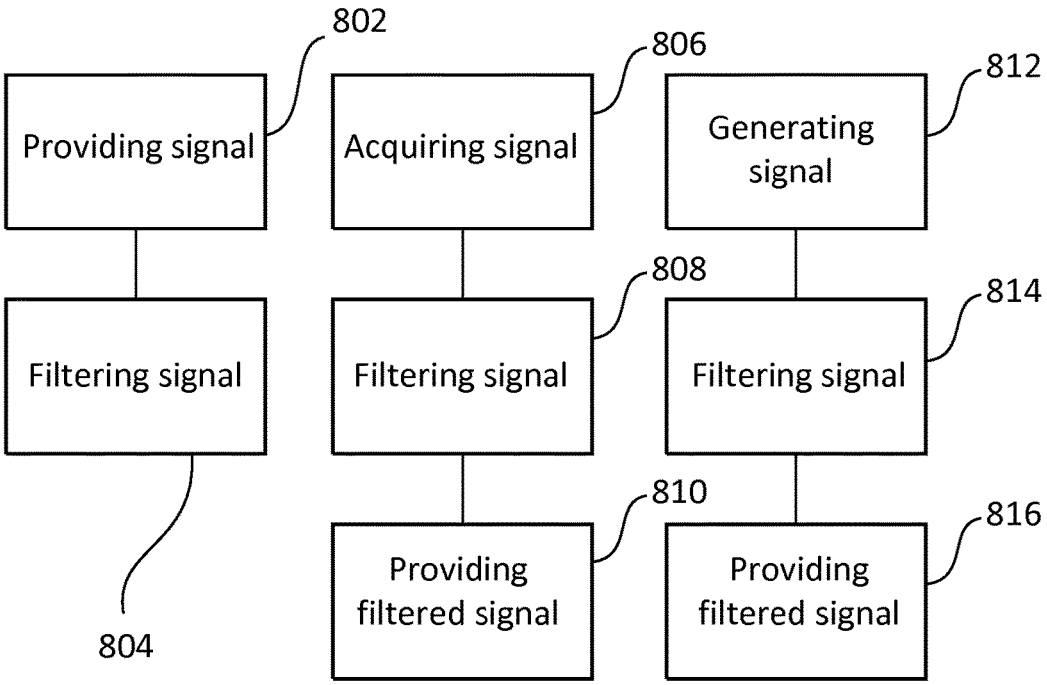
FIGS. 8A-C are flow charts outlining general method steps of methods according to embodiments of the present technique.

FIGS. 8A-C are flow charts outlining general steps of methods according to various embodiments of the present technique.

FIG. 8A illustrates the steps of a method for filtering a microwave signal in a waveguide E-plane band-pass filter. The method comprise providing 802 a microwave signal to the filter and band-pass filtering 804 the signal using the waveguide E-plane band-pass filter forming a filtered signal, the waveguide E-plane band-pass filter comprising at least one internal ridge protruding from an inner wall of the waveguide and extending longitudinally along the longitudinal direction of said waveguide.

FIG. 8B illustrates the steps of a method for filtering a microwave signal in a radio transceiver, the transceiver comprising a waveguide E-plane band-pass filter. The method comprises acquiring 806 a signal from an antenna band-pass filtering 808 the signal using the waveguide E-plane band-pass filter forming a filtered signal, the waveguide E-plane band-pass filter comprising at least one internal ridge protruding from an inner wall of the waveguide and extending longitudinally along the longitudinal direction of the waveguide, and providing 810 the filtered signal to a receiver module of the radio transceiver.

FIG. 8C illustrates the steps of a method for filtering a microwave signal in a radio transceiver, the transceiver comprising a waveguide E-plane band-pass filter. The method comprises generating 812 a signal by a radio transmitter module of the transceiver, band-pass filtering 814 the signal using the waveguide E-plane band-pass filter forming a filtered signal, the waveguide E-plane band-pass filter comprising at least one internal ridge protruding from an inner wall of the waveguide and extending longitudinally along the longitudinal direction of the waveguide body, and providing 816 the filtered signal to an antenna.

Even though the present technique has been described with reference to specific exemplifying embodiments thereof, many different alterations, modifications and the like will become apparent for those skilled in the art from a study of the drawings, the disclosure, and the appended claims.

Additionally, variations to the disclosed embodiments can be understood and effected by the skilled person in practicing the present technique.

The invention claimed is:

1. A waveguide E-plane band-pass filter comprising:

a tubular, electrically conductive waveguide body;

an electrically conductive foil arranged in said waveguide body and extending along a longitudinal direction of said waveguide body, said foil comprising a plurality of resonator openings;

wherein said waveguide body comprises at least one ridge protruding from an inner wall of said waveguide body in a plane extending into said waveguide body and extending longitudinally along the longitudinal direction of said waveguide body; and wherein said foil is in mechanical contact with said at least one ridge and arranged extending from said ridge and in another plane substantially parallel to the plane in which said ridge extends into said waveguide body to divide an inner volume of said waveguide body into two portions.

2. The filter according to claim 1, wherein said foil is arranged to divide said inner volume of said waveguide body into two portions of equal dimension.

3. The filter according to claim 1, wherein a cross-section of said at least one ridge has the same shape along the full length of said at least one ridge.

4. The filter according to claim 1, wherein said ridge comprises a plurality of protruding elements, a distance between adjacent protruding elements not exceeding a quarter of a wavelength of a center frequency of said filter.

5. The filter according to claim 1, wherein said at least one ridge has a rectangular cross section.

6. The filter according to claim 1, wherein said foil is in mechanical contact with a central portion of said at least one ridge along a longitudinal length of said ridge.

7. The filter according to claim 1, wherein a size and shape of said at least one ridge is selected such that a first harmonic frequency of said filter is located at a frequency of at least 1.5 times a center frequency of said filter.

8. The filter according to claim 1, wherein said foil is arranged along a symmetry line of said filter running along a longitudinal direction of said filter dividing said waveguide body into two symmetrical parts.

9. The filter according to claim 1, wherein said waveguide body comprises two body elements, each body element comprising one half of said at least one ridge, and said foil being arranged at an interface between said two body elements.

10. The filter according to claim 1, wherein said waveguide body comprises at least two body elements, and wherein one of said body elements comprises said at least one ridge.

11. The filter according to claim 1, wherein said waveguide body has a rectangular cross-section.

12. The filter according to claim 11, wherein said waveguide body comprises two ridges protruding from opposing walls of said waveguide body, wherein said foil is arranged extending between said two ridges.

13. The filter according to claim 12, wherein a cross section of said two ridges has the same shape along the longitudinal length of said two ridges.

14. The filter according to claim 12, wherein said two ridges are arranged opposing each other.

15. A diplexer unit, comprising:

a first filter according to claim 1, said first filter configured to be operatively connected to a radio transmitter and having a first passband;

a second filter according to claim 1, said second filter configured to be operatively connected to a receiver and having a second passband.

16. A radio transceiver comprising:

a radio transmitter;

a radio receiver;

a diplexer unit according to claim 15 operatively connected to said radio transmitter and to said radio receiver; and an antenna operatively connected to said diplexer unit.

17. A radio transceiver module for filtering a microwave signal, the transceiver comprising:

an antenna module for transmitting and receiving a microwave signal;

a first waveguide E-plane band-pass filter module for band-pass filtering a transmission signal to form a filtered transmission signal;

a second waveguide E-plane band-pass filter module for band-pass filtering an acquired signal to form a filtered acquired signal;

both said first and second waveguide E-plane band pass filter modules comprising:

at least one internal ridge protruding from an inner wall of a waveguide body in a plane into said waveguide body and extending longitudinally along the longitudinal direction of said waveguide body; and an electrically conductive foil, comprising a plurality of resonator openings, arranged in said waveguide body and extending along a longitudinal direction of said waveguide body, said foil being in mechanical contact with said at least one ridge and arranged extending from said ridge in another plane substantially parallel to the plane in which said ridge extends into said waveguide body to divide an inner volume of said waveguide body into two portions;

a radio transmitter module for providing said filtered transmission signal to an antenna; and a receiver module for receiving said filtered acquired signal from said filter.

* * * * *